US007581994B2

(12) United States Patent
Nakamura et al.

(10) Patent No.: US 7,581,994 B2
(45) Date of Patent: Sep. 1, 2009

(54) METHOD AND ASSEMBLY FOR ESTABLISHING AN ELECTRICAL INTERFACE BETWEEN PARTS

(75) Inventors: David J. Nakamura, La Palma, CA (US); Man-Fai Yu, Alhambra, CA (US); Bruce A. Igawa, Trabuco Canyon, CA (US)

(73) Assignee: The Boeing Company, Chicago, IL (US)

( * ) Notice: Subject to any disclaimer, the term of this patent is extended or adjusted under 35 U.S.C. 154(b) by 217 days.

(21) Appl. No.: 11/502,857

(22) Filed: Aug. 10, 2006

(65) Prior Publication Data

US 2008/0038965 A1 Feb. 14, 2008

(51) Int. Cl.
*H01R 9/24* (2006.01)
*H01R 13/02* (2006.01)

(52) U.S. Cl. ..... 439/886; 439/931

(58) Field of Classification Search ..... 439/886, 439/887, 931
See application file for complete search history.

(56) References Cited

U.S. PATENT DOCUMENTS

| | | | | |
|---|---|---|---|---|
| 4,447,109 | A * | 5/1984 | Hobart, Jr. | 439/851 |
| 4,657,322 | A * | 4/1987 | Grellmann et al. | 439/77 |
| 5,234,153 | A * | 8/1993 | Bacon et al. | 228/122.1 |
| 6,124,636 | A * | 9/2000 | Kusamitsu | 257/728 |
| 6,872,470 | B2 * | 3/2005 | Minamikawa | 428/672 |
| 2003/0029238 | A1 * | 2/2003 | Challoner | 73/504.04 |
| 2005/0224975 | A1 * | 10/2005 | Basavanhally et al. | 257/741 |
| 2007/0069368 | A1 * | 3/2007 | Archer et al. | 257/706 |
| 2007/0267646 | A1 * | 11/2007 | Wierer et al. | 257/98 |

* cited by examiner

*Primary Examiner*—Hae Moon Hyeon
(74) *Attorney, Agent, or Firm*—Law Office of Donald D. Mondul

(57) ABSTRACT

A method for establishing a substantially continuous electrical interface between a first expanse of a first electrical part and a second expanse of a second electrical part includes the steps of: (a) in no particular order: (1) Adhering a first layer of substantially pure gold material to at least a portion of the first expanse; and (2) adhering a second layer of substantially pure gold material to at least a portion of the second expanse. (b) Urging the first expanse and the second expanse together.

20 Claims, 3 Drawing Sheets

METHOD AND ASSEMBLY FOR ESTABLISHING AN ELECTRICAL INTERFACE BETWEEN PARTS

BACKGROUND OF THE INVENTION

The present invention is directed to electrical assemblies configured according to assembly methods, and especially to electrical assemblies and methods effecting inter-part electrical coupling in an assembled state.

Some electrical assemblies are designed to effect electrical contact between or among respective parts by pressure contact between or among parts during an assembly process that results in an assembled configuration of parts. By way of example and not by way of limitation, RF (radio frequency) microwave integrated circuit (MIC) modules are bolted into housings using mounting screws. A MIC module typically includes a two-conductor microstrip transmission line for conveying microwave signals. Establishing a required RF ground under the microstrip transmission line relies upon the pressure contact established between the MIC module and the housing as the MIC module is bolted into the housing. Because of surface irregularities and flatness issues regarding both of the parts—the housing and the MIC module—intermittent contact may be established at the interface between the housing and the MIC module. An intermittent contact interface may cause output power perturbations during operation of the assembly.

The primary conductor in the microstrip transmission line is typically a gold trace printed on dielectric material supporting the microstrip transmission line. Representative materials employed for such dielectric material includes, by way of example and not by way of limitation: alumina, Rogers 4003, TMM-10, duroid and other dielectric materials known in the art of MIC modules. By way of further example and not by way of limitation, the dielectric material may be attached to a gold or silver plated conductive header such as kover, silvar, stainless steel or another header material known in the art of MIC modules. The header material may be employed to act as the second conductor in the two-conductor microstrip transmission line.

Different microstrip modules may be electrically connected together via a gold ribbon that is welded or soldered between the respective microstrip transmission lines that are printed or otherwise affixed to the dielectric material. The header may typically be employed as a ground conductor and may be bolted to the housing. Bolting the parts together is preferred some assemblies for both mechanical and electrical reasons. However, bolting the header to the housing is known to experience the problem of intermittent contact between the housing and the header. Intermittent contact is caused by irregularities in the surface finish of the bottom of the header and the housing surface that contributes to less than ideal flatness of the interface between the header and the housing surface. Small high points, often of microscopic scale, make contact at the two surfaces presented at the interface between the housing and the header. These high points may move as the assembly is thermally cycled or vibrated. This movement may cause the inter-part contact points to move or shift. This moving or shifting action causes intermittent contact between parts at the header-to-housing interface that is manifested in perturbations shown in output power plots over a range of temperature.

This intermittent contact, sometimes referred to as "ground jumps", is often found in temperature cycling and may require extensive troubleshooting and rework to eliminate. Usually, these power jumps or perturbations are discovered during RF performance testing that typically involves temperature cycling. Troubleshooting and fixing the power jumps is very time consuming and costly as they require disassembly and reassembly using additional gold conducting ribbons between the header-to-housing interface.

One solution employs gold ribbon that is place between the header-to-housing interface underneath the RF transmission line to create a "gasket" affect so that the carrier (i.e., the microstrip transmission line) establishes a pressure contact in the region of the gold ribbon. Size and placement of ribbon may be variable geometry of the header-to-housing interface.

Incorrectly placed or incorrectly sized ribbons may lead to physical damage to solder or epoxy bond lines between the substrate and carrier or may lead to physical cracking of the substrate. Sufficiently reducing this intermittent contact problem to assure reliable performance by the header-to-housing interface usually involves a plurality of iterations of RF performance testing or temperature cycling.

There is a need for an assembly and a method for effecting the assembly that establishes a substantially continuous electrical interface between parts of the assembly in response to an urging together of the parts of the assembly.

SUMMARY OF THE INVENTION

A method for establishing a substantially continuous electrical interface between a first expanse of a first electrical part and a second expanse of a second electrical part includes the steps of: (a) in no particular order: (1) Adhering a first layer of substantially pure gold material to at least a portion of the first expanse; and (2) adhering a second layer of substantially pure gold material to at least a portion of the second expanse. (b) Urging the first expanse and the second expanse together.

An assembly configured according to the present invention includes: (a) A first part having a first expanse plated with substantially pure gold material. (b) A second part having a second expanse plated with substantially pure gold material. (c) An urging structure pressing the first expanse and the second expanse together to establish an electrical interface between the first part and the second part.

It is, therefore, a feature of the present invention to provide an assembly and a method for effecting the assembly that establishes a substantially continuous electrical interface between parts of the assembly in response to an urging together of the parts of the assembly.

Further features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

The present invention advantageously employs the phenomenon of gold diffusion to create an electrical and mechanical bond at the interface between parts of an assembly, such as by way of example and not by way of limitation a header-to-housing interface of an RF (radio frequency) microwave integrated circuit (MIC) module. An advantageous result is that intermittent electrical contact between parts at the header-to-housing interface is substantially reduced or eliminated, even in environments presenting temperature cycling or vibration.

Figure 1:
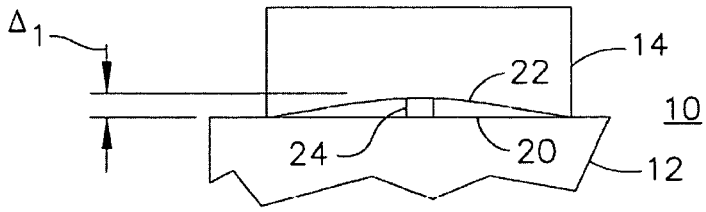
FIG. 1 (PRIOR ART)
FIG. 1 is a schematic elevation view of a first embodiment of an assembly configured according to the prior art.

FIG. 1 is a schematic elevation view of a first embodiment of an assembly configured according to the prior art. In FIG. 1, an assembly 10 includes a first part 12 and a second part 14. First part 12 has a substantially planar upper face 20. Second part 14 has a generally concave lower face 22 in facing relation with respect to face 20 when assembly 10 is in an assembled orientation, as illustrated in FIG. 1. In the assembled orientation illustrated in FIG. 1, faces 20, 22 cooperate to establish a gap $\Delta_1$ at widest separation between faces 20, 22. A ribbon structure 24 is installed between faces 20, 22 to at least partially fill gap $\Delta_1$. Preferably, ribbon structure 24 is gold material, and when faces 20, 22 are urged together an improved electrical interface is provided to an interface between faces 20, 22 by ribbon structure 24 compared with an interface between faces 20, 22 without ribbon structure 24 situated therebetween.

Figure 2:
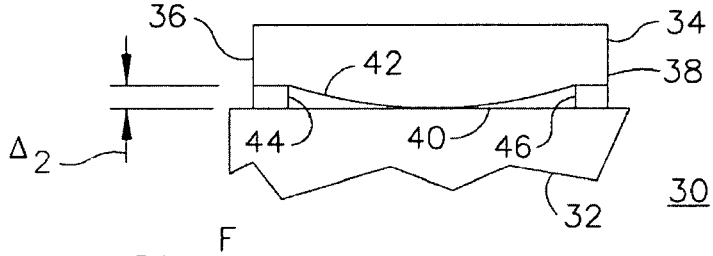
FIG. 2 (PRIOR ART)
FIG. 2 is a schematic elevation view of a second embodiment of an assembly configured according to the prior art.

FIG. 2 is a schematic elevation view of a second embodiment of an assembly configured according to the prior art. In FIG. 2, an assembly 30 includes a first part 32 and a second part 34. First part 32 has a substantially planar upper face 40. Second part 34 has a generally convex lower face 42 in facing relation with respect to face 40 when assembly 30 is in an assembled orientation, as illustrated in FIG. 2. In the assembled orientation illustrated in FIG. 2, faces 40, 42 cooperate to establish a gap $\Delta_2$ at widest separations between faces 40, 42 substantially at ends 36, 38 of assembly 30. Ribbon structures 44, 46 are installed between faces 40, 42 to at least partially fill gap $\Delta_2$ at ends 36, 38. Preferably, ribbon structures 44, 46 are gold material, and when faces 40, 42 are urged together an improved electrical interface is provided to an interface between faces 40, 42 by ribbon structures 44, 46 compared with an interface between faces 40, 42 without ribbon structures 44, 46 situated therebetween.

Prior art practice illustrated in FIGS. 1-2 provides for plating faces 20, 22 or 40, 42 using Type 2 (99.0% purity) gold plating on all mating portions of faces 20, 22 or 40, 42. Prior art practice also provides for ribbon structure to use Type 2 (99.0% purity) gold material. Prior art assemblies 10, 30 purposely employed lesser purity gold material (e.g., Type 2 (99.0% purity) gold material) for establishing electrical contact at an interface such as an interface between faces 20, 22 or 40, 42 in order to avoid occurrence of diffusion bonding by gold diffusion.

When mating gold surfaces are placed under pressure at an elevated temperature, the process of diffusion bonding starts to occur. Gold material is particularly susceptible to diffusion bonding, especially in structures involving substantially pure gold material. The process of diffusion bonding may be alternately referred to as "gold diffusion" elsewhere in this disclosure. This process of gold diffusion, also referred to as cold welding, can result in a strong bond between parts 12, 14 or 32, 34. Assembly designers have sought to avoid the occurrence of gold diffusion or cold welding in the past because the strong bond established by that process makes parts difficult to position and difficult to move once installed, such as when removal may be required for replacement or repair of an assembly.

When mating gold surfaces are placed in facing relationship under pressure at an elevated temperature, the process of gold diffusion starts to occur. The higher the elevated temperature (and pressure) the faster will be the diffusion rate. After a period of time, the diffusion is complete at the interface establishing a robust electrical contact and structural joint. Gold has the property of being able to diffuse and join to itself under a relatively low temperature and pressure.

Figure 3:
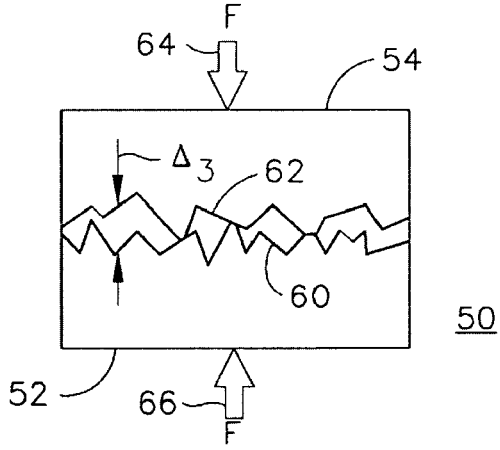
FIG. 3 is a schematic elevation view of a first step in effecting a diffusion bonding of two gold interfaces.
Figure 4:
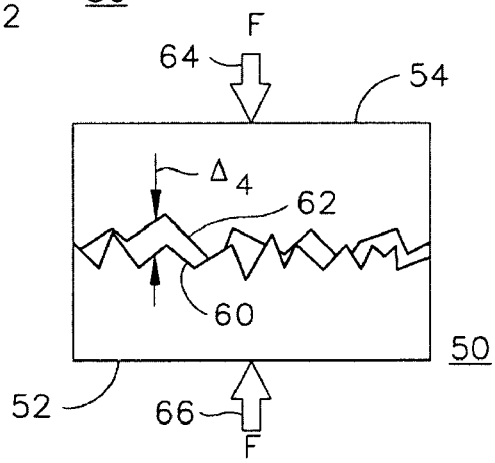
FIG. 4 is a schematic elevation view of a second step in effecting a diffusion bonding of two gold interfaces.
Figure 5:
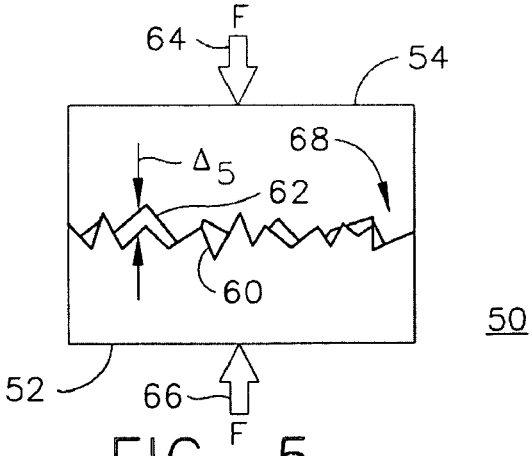
FIG. 5 is a schematic elevation view of a third step in effecting a diffusion bonding of two gold interfaces.
Figure 6:
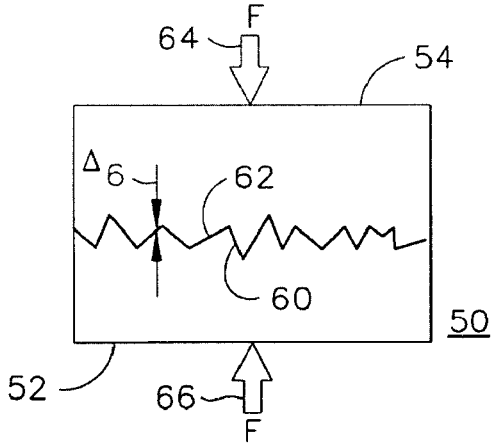
FIG. 6 is a schematic elevation view of a fourth step in effecting a diffusion bonding of two gold interfaces.

FIG. 3 is a schematic elevation view of a first step in effecting a diffusion bonding of two gold interfaces. FIG. 4 is a schematic elevation view of a second step in effecting a diffusion bonding of two gold interfaces. FIG. 5 is a schematic elevation view of a third step in effecting a diffusion bonding of two gold interfaces. FIG. 6 is a schematic elevation view of a fourth step in effecting a diffusion bonding of two gold interfaces. Regarding FIGS. 3-6 together, an assembly 50 includes a first part 52 and a second part 54. First part 52 has an upper face 60. Second part 54 has a lower face 62 in facing relation with respect to face 60 when assembly 50 is in an assembled orientation, as illustrated in FIGS. 3-6. Faces 60, 62 present gold material toward each other (not shown in detail in FIGS. 3-6). The gold material may be plated on or otherwise adhered with parts 52, 54.

In the first assembly step illustrated in FIG. 3, faces 60, 62 cooperate to establish a first gap (represented in FIG. 3 by gap $\Delta_3$) between faces 60, 62. Applying a force F (indicated by arrows 64, 66 in FIGS. 3-6) and elevating temperature of assembly 50 urges parts 52, 54 together and promotes gold diffusion or cold welding.

In the second assembly step illustrated in FIG. 4, application of force F and elevation of temperature result in faces 60, 62 establishing a second gap (represented in FIG. 4 by gap $\Delta_4$) between faces 60, 62 that is a lesser gap than first gap $\Delta_3$ (FIG. 3).

In the third assembly step illustrated in FIG. 5, application of force F and elevation of temperature result in faces 60, 62 establishing a third gap (represented in FIG. 5 by gap $\Delta_5$) between faces 60, 62 that is a lesser gap than second gap $\Delta_4$ (FIG. 4). The gap between faces 60, 62 is substantially zero in some localities, such as locality 68, as gold diffusion has substantially occurred in those localities.

In the fourth assembly step illustrated in FIG. 6, application of force F and elevation of temperature result in faces 60, 62 establishing a fourth gap (represented in FIG. 6 by gap $\Delta_6$) between faces 60, 62 that is a lesser gap than second gap $\Delta_5$ (FIG. 5). Fourth gap $\Delta_6$ is substantially zero wherever faces 60, 62 abut as gold diffusion has substantially occurred across the full interface of faces 60, 62, thereby establishing a cold welded junction having substantially continuous electrical properties and strong physical properties resistant to breaking the bond between parts 52, 54.

The present invention advantageously employs the phenomenon of gold diffusion bonding or cold welding between two gold surfaces to establish electrical and structural bond of sufficient quality and continuity to substantially eliminate intermittent contact between parts of an assembly. By way of example and not by way of limitation, the present invention advantageously employs the phenomenon of gold diffusion bonding or cold welding between two gold plated surfaces to establish an electrical and structural contact that substantially ensures a continuous electrical interface under a microstrip transmission line.

Cold welding of gold surfaces is a phenomenon that has been avoided by assembly designers for many years. Cold welding of gold surfaces has long been regarded as a problem to be avoided because it made parts difficult to move or position with respect to each other and for other assembly-related reasons. However, the present invention takes advantage of the phenomenon of cold welding of gold surfaces to solve the "ground jump" anomaly described above.

Figure 7:
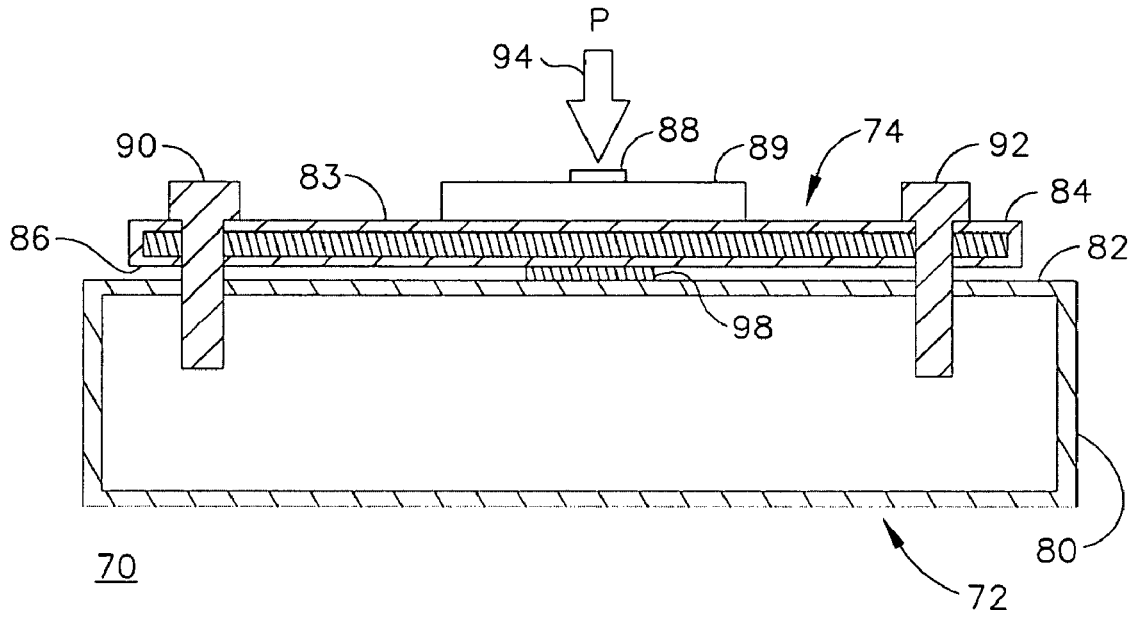
FIG. 7 is a schematic section view of an assembly configured according to the present invention.

FIG. 7 is a schematic section view of an assembly configured according to the present invention. In FIG. 7, an assembly 70 includes a first part 72 and a second part 74. First part 72 is preferably plated with a layer 80 of gold material and has an upper face 82. Second part 74 is preferably plated with a layer 84 of gold material and has a lower face 86 in facing relation with respect to face 82 when assembly 70 is in an assembled orientation, as illustrated in FIG. 7. Faces 82, 86 are in facing relation with each other. The gold material may be plated on or otherwise adhered with parts 72, 74.

A microwave transmission line 88 is carried upon a substrate 89 on an upper surface 83 of part 74. Screw fasteners 90, 92 cooperate with parts 72, 74 to urge parts 72, 74 with a pressure force P indicated by an arrow 94. Elevating temperature of assembly 70 while screwing screw fasteners 90, 92 to apply pressure force P between parts 72, 74 applies a compression force between faces 82, 86 sufficient to affect gold diffusion or cold welding as described earlier herein in connection with FIGS. 3-6 where faces 82, 86 abut. An alternate embodiment of assembly 70 may provide for a gold ribbon member 98 situated between faces 82, 86.

Assembly 70 advantageously employs the phenomenon of gold diffusion or cold welding for establishing a substantially continuous electrical interface between faces 82, 86 with strong physical properties resisting separation of parts 72, 74. An alternate embodiment of assembly 70 (using ribbon member 98) employs the previously avoided prior art practice of placing gold ribbons between parts, such as between a carrier-to-housing interface (FIGS. 1-2) to advantageously enhance electrical and physical properties of a bond between the parts.

Assembly 70 employs a high purity gold plating (e.g., AMS B 488 Type 3; purity=99.90%) for gold layers 80, 84. Prior art practice preferred using gold plating having a lesser purity (e.g., AMS B 488 Type 2; purity=99.0%) in order to avoid the occurrence of gold diffusion or cold welding. Type 3 gold is a high purity gold plating having substantially no brighteners or additives. When employed, ribbon member 98 is preferably a high purity gold ribbon (e.g., AMS B 488 Type 3; purity=99.90%). A preferred thickness for ribbon member 98 is generally in the range of 0.001 to 0.0005 inches. This preferred combination of materials for configuring assembly 70 encourages occurrence of gold diffusion or cold welding when the parts 82, 84 and (if employed) ribbon member 94 are joined in an interface structure during a bolting down process, such as by tightening screw fasteners 90, 92. Performing temperature cycling or providing elevated temperature while effecting a bolting down process will assist or accelerate the gold diffusion or cold welding process. Once gold diffusion or cold welding has occurred, the interface between parts 72, 74 will not have significant intermittent contact as temperature changes or vibration occur, thereby establishing a robust microwave ground interface connection.

In an alternate embodiment of assembly 70, lesser purity gold plating (e.g., Type 2) may be plated on one or more of parts 82, 86 so long as ribbon member 98 is configured using high purity gold ribbon (e.g., Type 3) is gap welded to the surface of the part or parts 82, 86 plated with lesser purity gold. Ribbon member 98 used in assembly 70 may be in a fully annealed condition (preferred), an intermediately annealed condition or a full hard condition.

Surface preparation of faces 82, 86 (and when used, ribbon member 98) prior to the diffusion bonding process is preferred in order to clean off contaminating material that may be present at the interface between parts 72, 74 that is to be diffusion bonded. Contaminants may act as diffusion barriers and reduce the effectiveness or completeness of the diffusion bonding or cold welding process.

Once assembly 70 is bolted down to apply pressure P to the interface between parts 72, 74, assembly 70 is preferably allowed to thermally age at an elevated temperature to allow gold diffusion or cold welding to take place.

Figure 8:
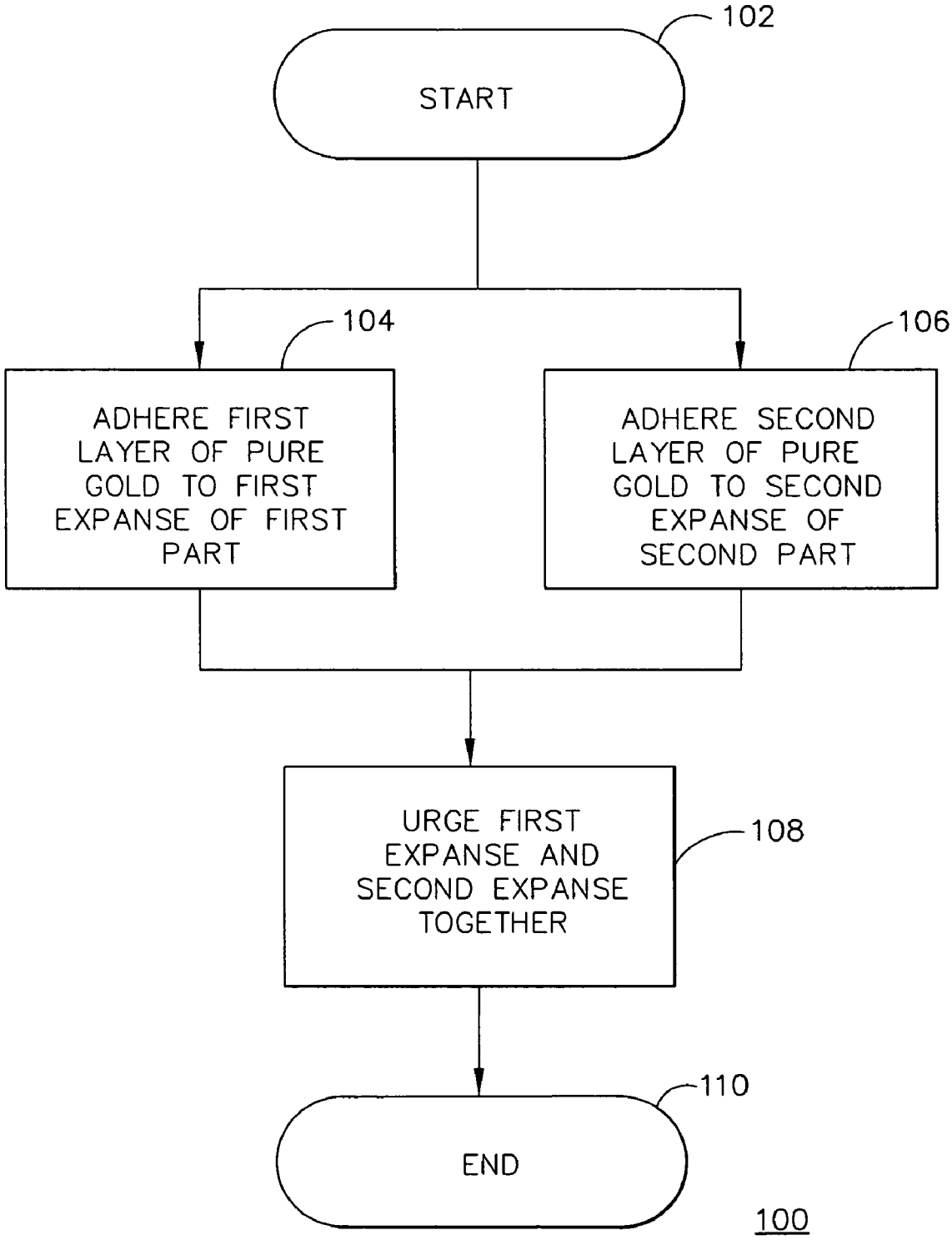
FIG. 8 is a flow chart illustrating the method of the present invention.

FIG. 8 is a flow chart illustrating the method of the present invention. In FIG. 8, a method 100 for establishing a substantially continuous electrical interface between a first expanse of a first electrical part and a second expanse of a second electrical part begins at a START locus 102. Method 100 continues with the step of, in no particular order: (1) adhering a first layer of substantially pure gold material to at least a portion of the first expanse, as indicated by a block 104; and (2) adhering a second layer of substantially pure gold material to at least a portion of the second expanse, as indicated by a block 106. Method 100 continues by urging the first expanse and the second expanse together, as indicated by a block 108. Method 100 terminates at an END locus 110.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

We claim:

1. A method for establishing a substantially bonded substantially electrically continuous interface between a first expanse of a first electrical part and a second expanse of a second electrical part; the method comprising the steps of:

(a) in no particular order:

(1) adhering a first layer of substantially pure gold material to at least a portion of said first expanse; and (2) adhering a second layer of substantially pure gold material to at least a portion of said second expanse; and (b) urging said first expanse and said second expanse together without substantially elevating temperature of said first electrical part or said second electrical part; said substantially pure gold material and said urging cooperating to substantially eliminate intermittent electrical contact between said first electrical part and said second electrical part.

2. The method for establishing a substantially bonded substantially electrically continuous interface between a first expanse of a first electrical part and a second expanse of a second electrical part as recited in claim 1 wherein said gold material is substantially 99.9 percent pure gold material.

3. The method for establishing a substantially bonded substantially electrically continuous interface between a first expanse of a first electrical part and a second expanse of a second electrical part as recited in claim 1 wherein said gold material is an AMS B 488 Type 3 gold plating material.

4. The method for establishing a substantially bonded substantially electrically continuous interface between a first expanse of a first electrical part and a second expanse of a second electrical part as recited in claim 1 wherein said gold material is adhered to said first expanse and to said second expanse using a gold plating process.

5. The method for establishing a substantially bonded substantially electrically continuous interface between a first expanse of a first electrical part and a second expanse of a second electrical part as recited in claim 2 wherein said gold material is adhered to said first expanse and to said second expanse using a gold plating process.

6. The method for establishing a substantially bonded substantially electrically continuous interface between a first expanse of a first electrical part and a second expanse of a second electrical part as recited in claim 1 wherein said urging establishes a common contact area between said first electrical part and said second electrical part; said common contact area having a substantially complete gold-to-gold interface.

7. The method for establishing a substantially bonded substantially electrically continuous interface between a first expanse of a first electrical part and a second expanse of a second electrical part as recited in claim 1 wherein said urging is effected using a compression connection between said first electrical part and said second electrical part.

8. The method for establishing a substantially bonded substantially electrically continuous interface between a first expanse of a first electrical part and a second expanse of a second electrical part as recited in claim 2 wherein the method further comprises a step: inserting at least one expanse of a ribbon configuration of said gold material between said first layer and said second layer before said urging together of said first expanse and said second expanse.

9. A method for assembling a first part and a second part to establish a substantially bonded electrical interface between said first part and said second part; the method comprising the steps of:

(a) in no particular order:

(1) plating a first expanse of said first part with a substantially pure gold material; and (2) plating a second expanse of said second part with said substantially gold material;

(b) clamping said first part and said second part together in an assembled orientation without substantially elevating temperature of said first part or said electrical part; said assembled orientation establishing said first expanse and said second expanse in a facing relationship said substantially pure gold material and said urging cooperating to substantially eliminate intermittent electrical contact between said first part and said second part.

10. The method for assembling a first part and a second part to establish a substantially bonded electrical interface between said first part and said second part as recited in claim 9 wherein said gold material is substantially 99.9 percent pure gold material.

11. The method for assembling a first part and a second part to establish an substantially bonded electrical interface between said first part and said second part as recited in claim 9 wherein said gold material is an AMS B 488 Type 3 gold material.

12. The method for assembling a first part and a second part to establish a substantially bonded electrical interface between said first part and said second part as recited in claim 9 wherein said clamping establishes a common contact area between said first part and said second part; said common contact area having a substantially complete gold-to-gold interface.

13. The method for assembling a first part and a second part to establish a substantially bonded electrical interface between said first part and said second part as recited in claim 10 wherein said clamping establishes a common contact area between said first part and said second part; said common contact area having a substantially complete gold-to-gold interface.

14. The method for assembling a first part and a second part to establish a substantially bonded electrical interface between said first part and said second part as recited in claim 9 wherein the method further comprises a step: inserting at least one expanse of a ribbon configuration of said gold material between said first expanse and said second expanse after said plating of said first expanse and said plating of said second expanse and before said urging together of said first part and said second part.

15. An assembly comprising:

(a) a first part; said first part having a first expanse plated with substantially pure gold material;

(b) a second part; said second part having a second expanse plated with substantially pure gold material; and (c) an urging structure; said urging structure pressing said first expanse and said second expanse together without substantially elevating temperature of said first part or said second part to establish a substantially bonded electrical interface between said first part and said second part; said substantially pure gold material and said pressing cooperating to substantially eliminate intermittent electrical contact between said first part and said second part.

16. The assembly as recited in claim 15 wherein said gold material is substantially 99.9 percent pure gold material.

17. The assembly as recited in claim 15 wherein said gold material is an AMS B 488 Type 3 gold material.

18. The assembly as recited in claim 15 wherein said urging establishes said electrical interface area as a substantially complete gold-to-gold interface.

19. The assembly as recited in claim 16 wherein said urging establishes said electrical interface area as a substantially complete gold-to-gold interface.

20. The assembly as recited in claim 15 wherein the assembly further comprises at least one expanse of a ribbon configuration of said gold material between said first plated expanse and said second plated expanse.

* * * * *

UNITED STATES PATENT AND TRADEMARK OFFICE

CERTIFICATE OF CORRECTION

PATENT NO. : 7,581,994 B2
APPLICATION NO. : 11/502857
DATED : September 1, 2009
INVENTOR(S) : Nakamura et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 239 days.

Signed and Sealed this

Fourteenth Day of September, 2010

David J. Kappos

David J. Kappos
*Director of the United States Patent and Trademark Office*